US011591048B1

(12) United States Patent
Doss et al.

(10) Patent No.: US 11,591,048 B1
(45) Date of Patent: Feb. 28, 2023

(54) BLOCK AND TACKLE ASSEMBLY FOR BLADDER ANCHOR

(71) Applicant: Hotwire Development, LLC, Scottsdale, AZ (US)

(72) Inventors: Jeffrey S. Doss, Scottsdale, AZ (US); Jason Swanson, Fountain Hills, AZ (US); David M. Daniel, Phoenix, AZ (US)

(73) Assignee: Hotwire Development, LLC, Scottsdale, AZ (US)

( * ) Notice: Subject to any disclaimer, the term of this patent is extended or adjusted under 35 U.S.C. 154(b) by 133 days.

(21) Appl. No.: 17/174,214

(22) Filed: Feb. 11, 2021

(51) Int. Cl.
*B63B 21/22* (2006.01)
*B63B 21/04* (2006.01)
*B63B 21/00* (2006.01)

(52) U.S. Cl.
CPC ..... *B63B 21/22* (2013.01); *B63B 21/04* (2013.01); *B63B 2021/003* (2013.01)

(58) Field of Classification Search
CPC .... B63B 21/22; B63B 21/04; B63B 2021/003
See application file for complete search history.

(56) References Cited

U.S. PATENT DOCUMENTS 4,162,561 A * 7/1979 Tillemans ..... H01B 17/58 24/134 P
5,675,872 A * 10/1997 Emery ..... A63B 51/16 24/130
5,987,711 A * 11/1999 Parsons ..... F16G 11/103 24/130
6,094,783 A * 8/2000 Parsons ..... B60P 7/0823 24/130
6,115,889 A * 9/2000 Mickelson ..... A01K 1/04 24/115 R
6,260,498 B1 * 7/2001 Cochran ..... B63B 21/08 24/130
6,651,577 B1 * 11/2003 Gates ..... B63B 21/00 114/230.22
6,722,303 B2 * 4/2004 Lob ..... B63B 21/08 114/218
6,857,381 B2 * 2/2005 Siewert ..... B63B 21/08 114/218
7,513,207 B2 * 4/2009 Walker ..... F16G 11/103 254/391
10,066,357 B2 * 9/2018 Rosier ..... E02D 5/803
(Continued)

*Primary Examiner* — S. Joseph Morano
*Assistant Examiner* — Jovon E Hayes
(74) *Attorney, Agent, or Firm* — Booth Udall Fuller, PLC; Kenneth C. Booth

(57) ABSTRACT

A pulley system for tying a boat to an anchor comprising a block and tackle assembly and a jammer. The block and tackle assembly has a plurality of pulleys arranged on a first bracket and a second bracket, and a first rope strung sequentially through each of the pulleys, ending with a last pulley. The jammer is coupled to the second bracket and has a channel and a jammer exit at the end of the channel. The last pulley, the channel, and the jammer exit are configured to create a tortuous path for the rope through the second bracket. The channel may be misaligned with the last pulley. A swivel and a rope clip may be coupled to the block and tackle assembly. The swivel is configured to rotate at least 360 in either direction. The rope clip is configured to allow for quick tightening of the pulley system.

19 Claims, 12 Drawing Sheets

(56) References Cited

U.S. PATENT DOCUMENTS

| | | | | |
|---|---|---|---|---|
| 2003/0228807 | A1* | 12/2003 | Mello | H01R 4/5083<br>439/796 |
| 2009/0072544 | A1* | 3/2009 | Pao | B63B 21/04<br>290/55 |
| 2009/0223428 | A1* | 9/2009 | Kivi | B63B 21/24<br>114/230.1 |

* cited by examiner

BLOCK AND TACKLE ASSEMBLY FOR BLADDER ANCHOR

TECHNICAL FIELD

Aspects of this document relate generally to block and tackle assemblies, and more specifically to block and tackle assemblies used to tie a boat to a bladder anchor.

BACKGROUND

Boat anchors are common devices used to connect a vessel to the bed or shoreline of a body of water to prevent the craft from drifting due to wind, waves or current. One type of anchor that works well when a shoreline is formed of a rocky or hard material is a bladder anchor that is placed on the shore of the body of water and then filled with water. The boat is then tied to the bladder anchor to limit the movement of the boat. Other types of anchors can also be placed or buried on the shore and then tied to the boat. However, it can be difficult to effectively tighten the rope used to tie the boat to the anchor. To pull the rope tight, the boat must be pulled towards the anchor, which can be difficult, especially with larger, heavier boats. Therefore, what is needed is a mechanism that facilitates tying the boat to the anchor.

SUMMARY

Aspects of this document relate to a pulley system for tying a boat to an anchor, comprising a block and tackle assembly having a plurality of pulleys and a first rope, wherein a first pulley and a third pulley of the plurality of pulleys are axially aligned with each other and rotatably coupled to a first bracket, a second pulley and a fourth pulley of the plurality of pulleys are axially aligned with each other and rotatably coupled to a second bracket distal to the first bracket, the first rope is strung sequentially through the first pulley, the second pulley, the third pulley, and the fourth pulley, and a first portion of the first rope is fixedly coupled to the second bracket, a mesh bag surrounding a majority of the block and tackle assembly and positionally attached to each of the first bracket and the second bracket, the mesh bag having a marker line on a side of the mesh bag, the marker line configured to maintain its position on the side of the mesh bag and indicate whether the plurality of pulleys and the first rope of the block and tackle assembly within the mesh bag are properly aligned for untangled operation of the block and tackle assembly, a jammer coupled to the second bracket and having a channel misaligned with the second pulley and the fourth pulley, wherein the channel has two walls each with a plurality of teeth and a dimple extending into the channel between the two walls, wherein the jammer is configured to receive a second portion of the first rope within the channel and secure the second portion of the first rope with the plurality of teeth and the dimples, a swivel coupled to the second bracket of the block and tackle assembly and to a second rope, the swivel configured to rotate 360 degrees in both a clockwise direction and a counterclockwise direction, and a rope clip hingedly coupled to the first bracket of the block and tackle assembly and coupled to a third rope, wherein the rope clip comprises a housing having a large end adjacent to the first bracket, a small end distal to the first bracket, and a plurality of sets of teeth between the large end and the small end, the large end having a larger cross-sectional area than the small end, wherein the third rope extends through a gap between the plurality of sets of teeth within the rope clip and the plurality of sets of teeth within the housing are configured to move closer to each other near the small end and farther away from each other near the large end, wherein when the third rope extends through the rope clip and is drawn away from the block and tackle assembly, the third rope moves the plurality of sets of teeth toward the small end and the gap between the plurality of sets of teeth tightens around the third rope, and wherein, when the third rope extends through the rope clip and is drawn toward the block and tackle assembly, the third rope moves the plurality of sets of teeth toward the large end and the gap between the plurality of sets of teeth widens, thereby releasing the third rope.

Particular embodiments may comprise one or more of the following features. The dimple on a first wall of the two walls may be aligned with the dimple on a second wall of the two walls and a width of a gap between the dimple on the first wall and the dimple on the second wall may be smaller than a width of the first rope. The rotation of the swivel may occur about an axis extending through the first bracket and the second bracket. The mesh bag may be made of a mesh material with a plurality of small apertures extending through the mesh material, wherein the small apertures are sized to allow a user to see a relative alignment of the first rope through the mesh material.

Aspects of this document relate to a pulley system for tying a boat to an anchor, comprising a block and tackle assembly having a plurality of pulleys, wherein each pulley of a first group of pulleys of the plurality of pulleys is coupled to a first bracket on a first end of the block and tackle assembly, each pulley of a second group of pulleys of the plurality of pulleys is coupled to a second bracket on a second end of the block and tackle assembly distal to the first bracket, and the plurality of pulleys is configured to receive a first rope, fixedly coupled to the second bracket, through each pulley of the plurality of pulleys, ending with a last pulley on the second bracket, the second bracket having a jammer with a channel and a jammer exit at the end of the channel, wherein the pulley system is configured to receive a second portion of the first rope threaded around the pulley, through the jammer, and out the jammer exit, wherein the last pulley, the channel of the jammer, and the jammer exit are configured to create a tortuous path for the rope through the second bracket, the tortuous path begins where the rope loses contact with the last pulley and ends at the jammer exit, and the rope changes direction by more than 20 degrees along the tortuous path, and wherein the first end has a first system coupling configured to couple to a boat and the second end has a second system coupling configured to couple to an anchor.

Particular embodiments may comprise one or more of the following features. At least one of the first end or the second end may further comprise a rope clip coupled between the boat and the first system coupling or between the anchor and the second system coupling, wherein the rope clip is configured to secure a third rope when the third rope extends through the rope clip and is drawn away from the block and tackle assembly, and release the third rope when the third rope extends through the rope clip and is drawn toward the block and tackle assembly. The rope clip may comprise a housing having a large end adjacent to the first bracket, a small end distal to the first bracket, and a plurality of sets of teeth between the large end and the small end, the large end having a larger cross-sectional area than the small end, wherein the third rope extends through a gap between the plurality of sets of teeth within the rope clip and the plurality of sets of teeth within the housing are configured to move closer to each other near the small end and farther away from each other near the large end, wherein, when the third rope extends through the rope clip and is drawn away from the block and tackle assembly, the third rope moves the plurality of sets of teeth toward the small end and the gap between the plurality of sets of teeth tightens around the third rope, and wherein, when the third rope extends through the rope clip and is drawn toward the block and tackle assembly, the third rope moves the plurality of sets of teeth toward the large end and the gap between the plurality of sets of teeth widens, thereby releasing the third rope. The pulley system may further comprise a mesh bag surrounding a majority of the block and tackle assembly and positionally attached to each of the first bracket and the second bracket, the mesh bag having a marker line on a side of the mesh bag, the marker line configured to maintain its position on the side of the mesh bag and indicate whether the plurality of pulleys and the first rope of the block and tackle assembly within the mesh bag are properly aligned for untangled operation of the block and tackle assembly. The rotation of the swivel may occur about an axis extending through the first bracket and the second bracket. The jammer may further have a plurality of teeth extending into the channel, wherein the jammer is configured to secure the second portion of the first rope with the plurality of teeth. The jammer exit may have at least two dimples, wherein the at least two dimples are located on opposite walls of the channel, each of the at least two dimples are aligned with another of the at least two dimples, and a gap between the at least two dimples is smaller than a width of the first rope. The channel may be misaligned with the last pulley of the plurality of pulleys. At least one of the first end or the second end may further have a swivel coupled directly to the first system coupling or the second system coupling and configured to rotate 360 degrees.

Aspects of this document relate to a pulley system for tying a boat to an anchor, comprising a bracket having at least one pulley and a jammer positioned to receive a rope from the at least one pulley, the jammer having a channel and a jammer exit at the end of the channel, wherein the pulley system is configured to receive a rope threaded around the pulley, through the jammer, and out the jammer exit, wherein the pulley, the channel of the jammer, and the jammer exit are configured to create a tortuous path for the rope through the bracket comprising a direction change of at least 20 degrees along the tortuous path, wherein the tortuous path begins where the rope loses contact with the pulley and ends at the jammer exit.

Particular embodiments may comprise one or more of the following features. The jammer may further have a plurality of teeth extending into the channel, wherein the jammer is configured to secure the rope within the channel with the plurality of teeth. The jammer exit may have at least two dimples, wherein the at least two dimples are located on opposite walls of the channel, each of the at least two dimples are aligned with another of the at least two dimples, and a gap between the at least two dimples is smaller than a width of the first rope. The channel may be misaligned with the at least one pulley. The bracket may be a second bracket, the pulley system further comprising a block and tackle assembly configured to receive the rope, wherein the block and tackle assembly has a plurality of pulleys including the at least one pulley, wherein each pulley of a first group of pulleys of the plurality of pulleys is coupled to a first bracket on a first end of the block and tackle assembly, each pulley of a second group of pulleys of the plurality of pulleys is coupled to the second bracket on a second end of the block and tackle assembly distal to the first bracket, and the plurality of pulleys is configured to receive the rope, fixedly coupled to the second bracket, through each pulley of the plurality of pulleys, ending with the at least one pulley. The pulley system may further comprise a mesh bag surrounding a majority of the block and tackle assembly and positionally attached to each of the first bracket and the second bracket, the mesh bag having a marker line on a side of the mesh bag, the marker line configured to maintain its position on the side of the mesh bag and indicate whether the plurality of pulleys and the first rope of the block and tackle assembly within the mesh bag are properly aligned for untangled operation of the block and tackle assembly. The rope may change direction by more than 20 degrees along the tortuous path.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that he can be his own lexicographer if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
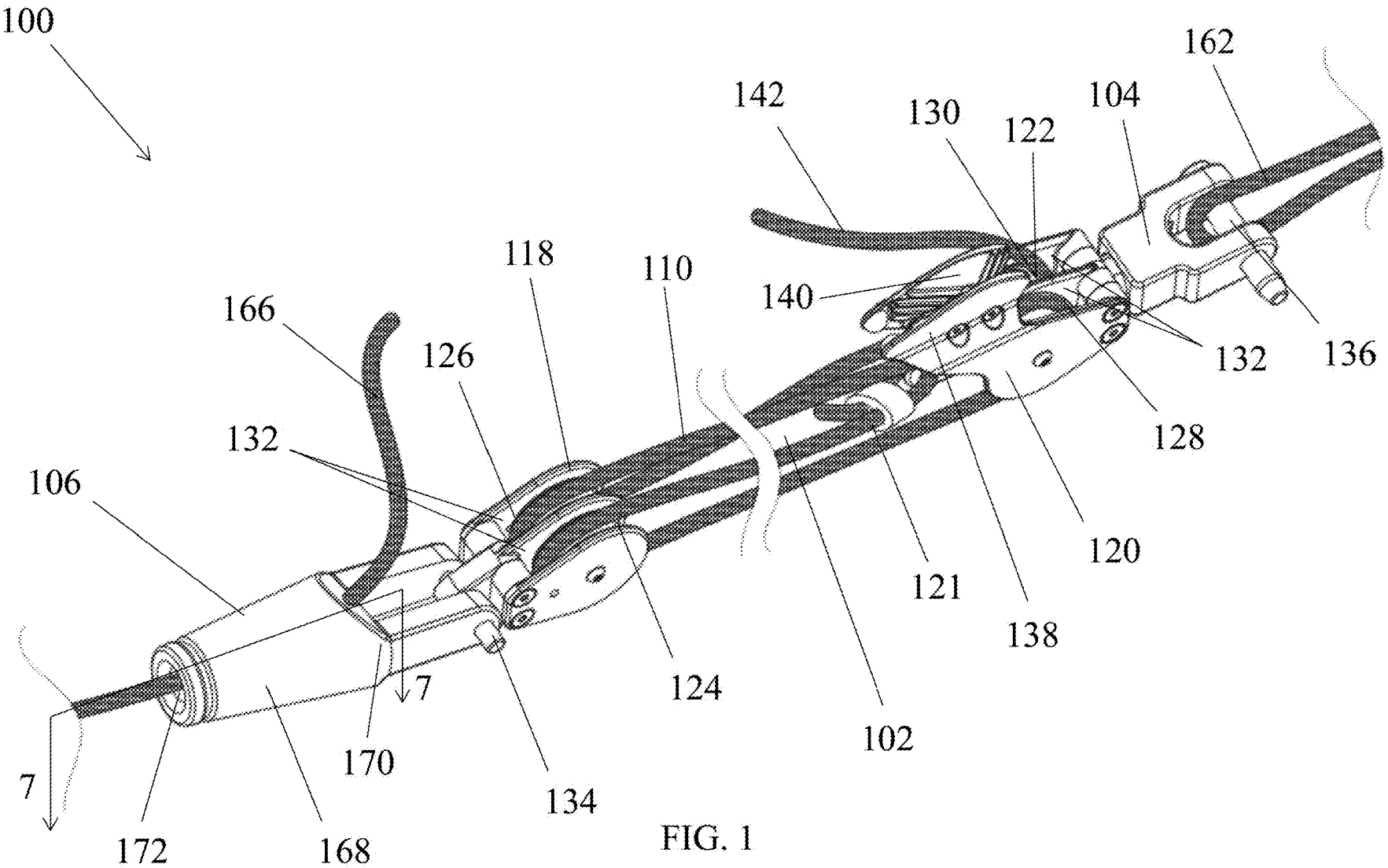
FIG. 1 is a perspective view of an embodiment of the pulley system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

FIGS. 1 through 5B illustrate different embodiments of a pulley system 100. The pulley system 100 is designed to facilitate tying a boat 10 to an anchor 20. The implementation of the pulley system 100 shown in FIG. 1 has a block and tackle assembly 102, a swivel 104, and a rope clip 106. The embodiment shown in FIGS. 2-5B is similar, but does not have a rope clip 106. The block and tackle assembly 102, the swivel 104, and the rope clip 106 function together to simplify the process of anchoring a boat 10. As will be discussed in more detail below, the pulley system 100 is attached to the anchor 20 and to the boat 10, and is then tightened to secure the boat 10. The term rope as used herein is intended to include cables, wires, cords, lines, hawsers, straps, strings, or any other long, thin material commonly used to couple two distal objects together.

Figure 2:
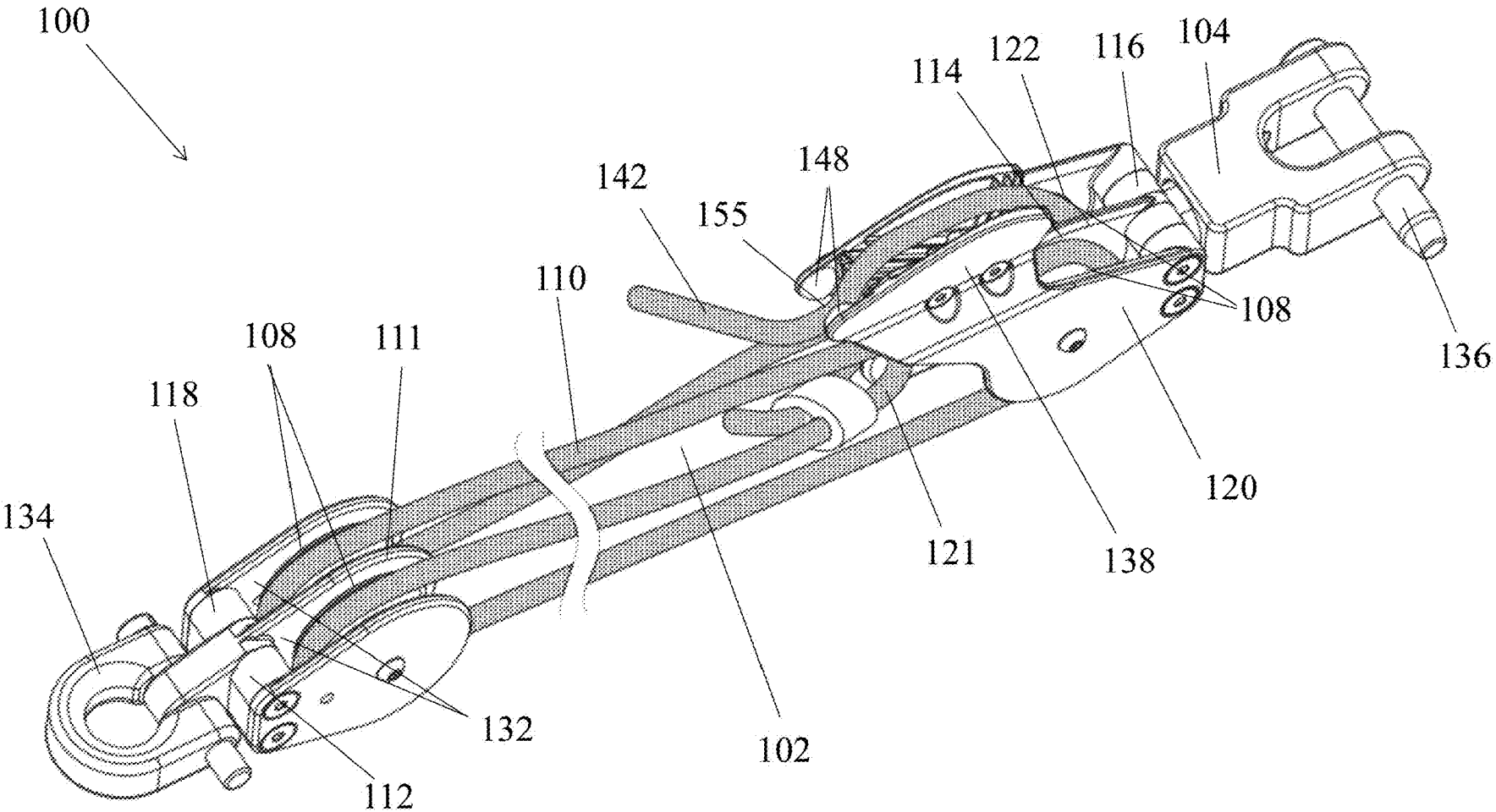
FIG. 2 is a perspective view of another embodiment of the pulley system without a rope clip.
Figure 3A:
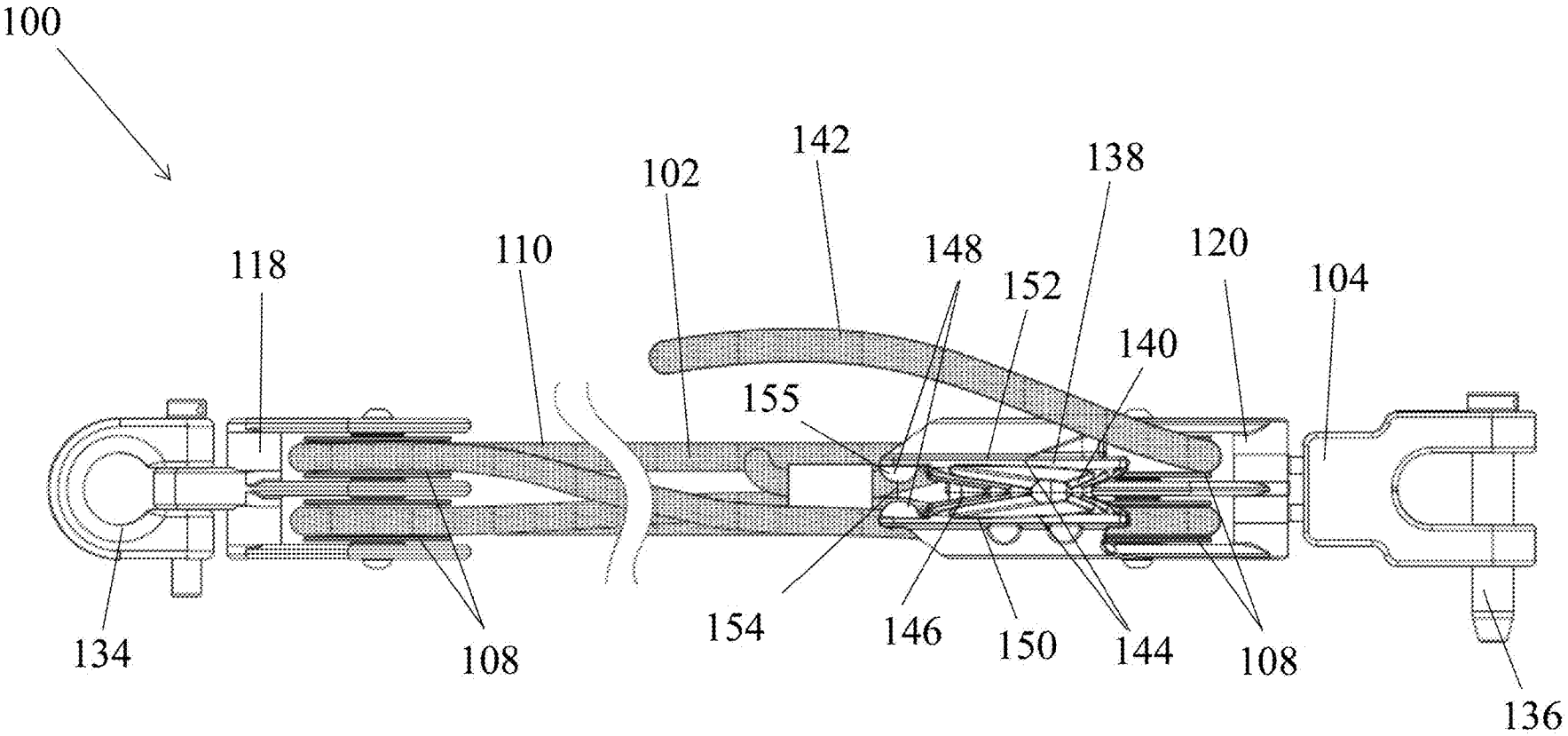
FIG. 3A is a top view of the pulley system of FIG. 2 with the second portion of the rope outside of the jammer.
Figure 3B:
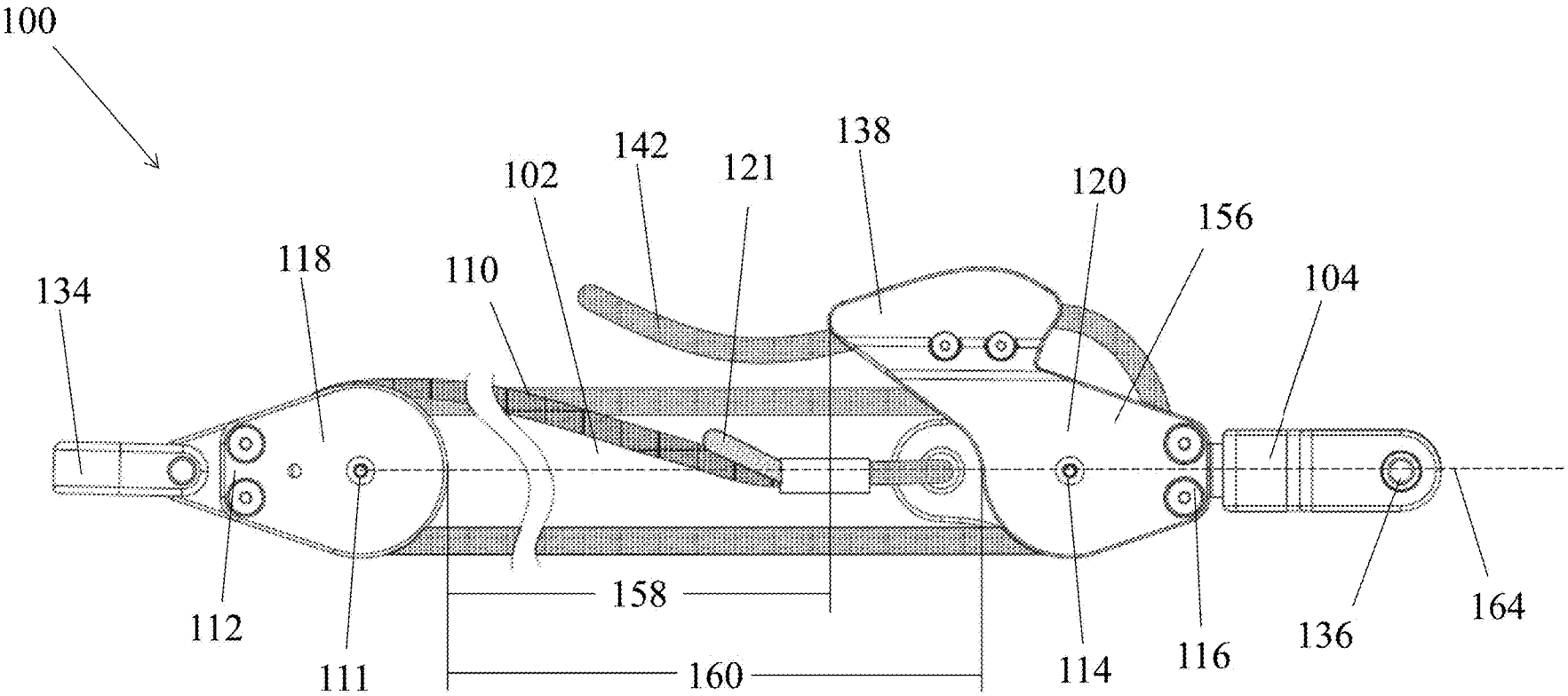
FIG. 3B is a side view of the pulley system of FIG. 2 with the second portion of the rope outside of the jammer.
Figure 4A:
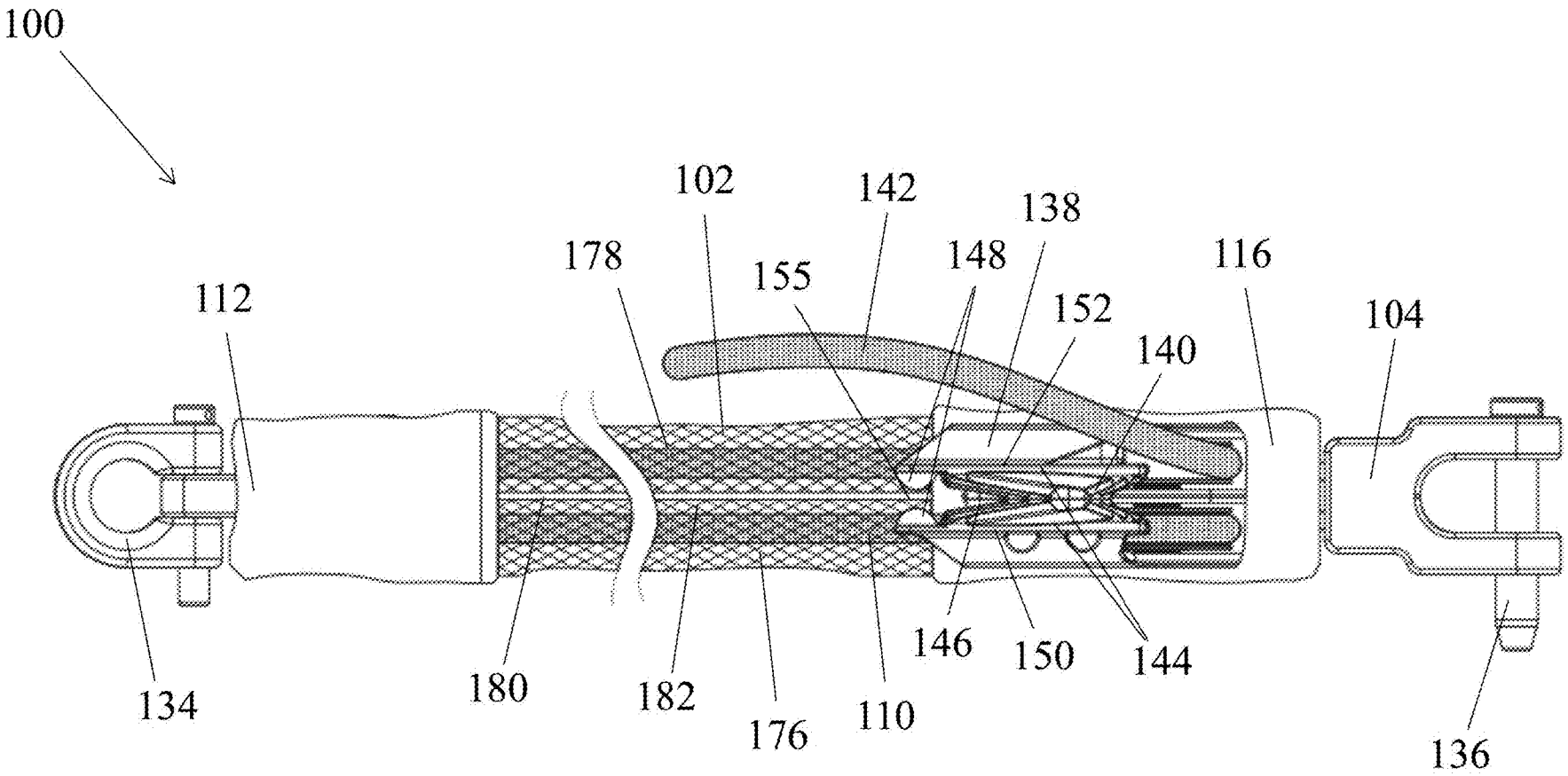
FIG. 4A is a top view of the pulley system of FIG. 2 with a mesh bag surrounding the block and tackle assembly and the second portion of the rope outside of the jammer.
Figure 4B:
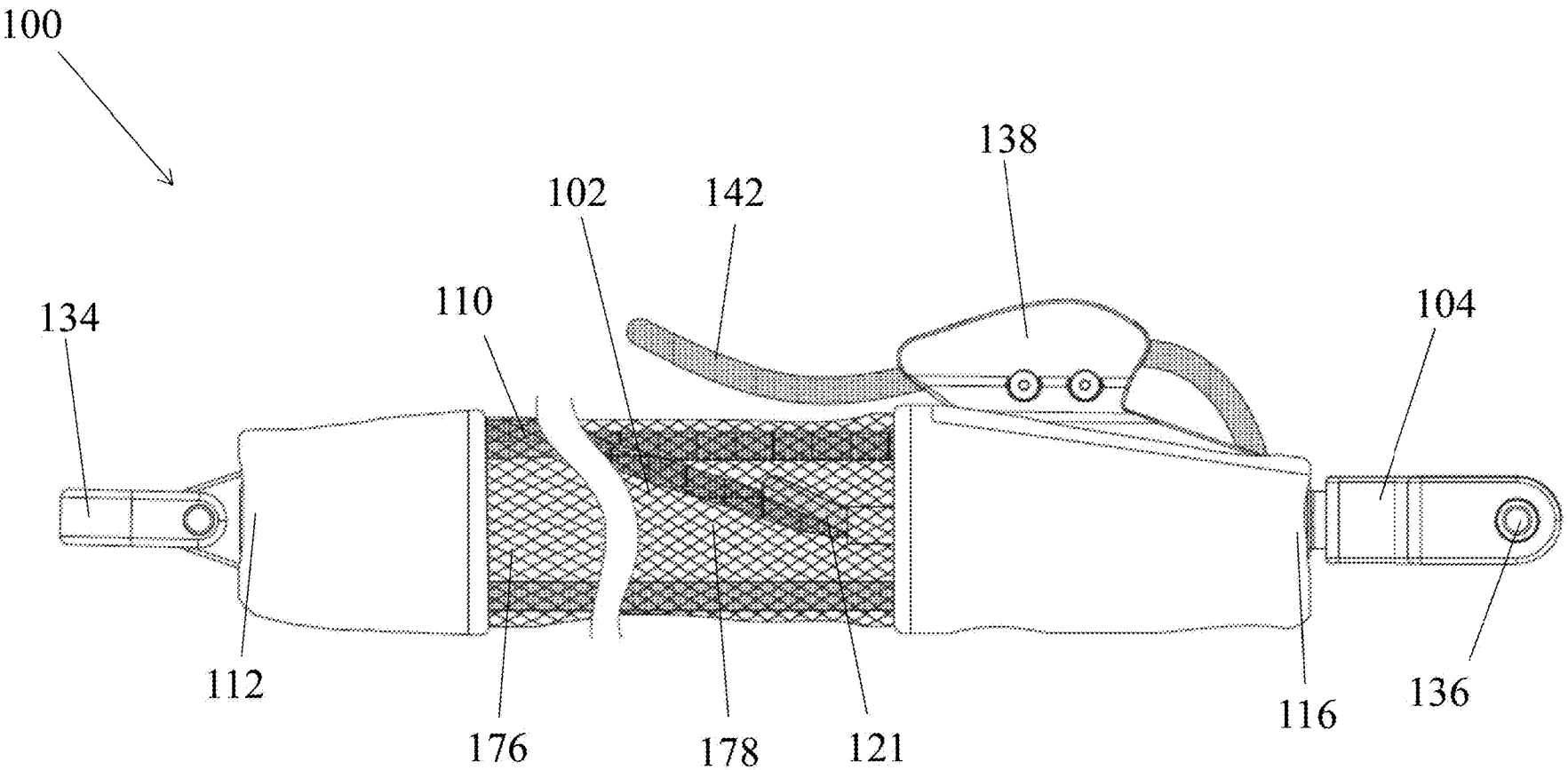
FIG. 4B is a side view of the pulley system of FIG. 2 with a mesh bag surrounding the block and tackle assembly and the second portion of the rope outside of the jammer.
Figure 5A:
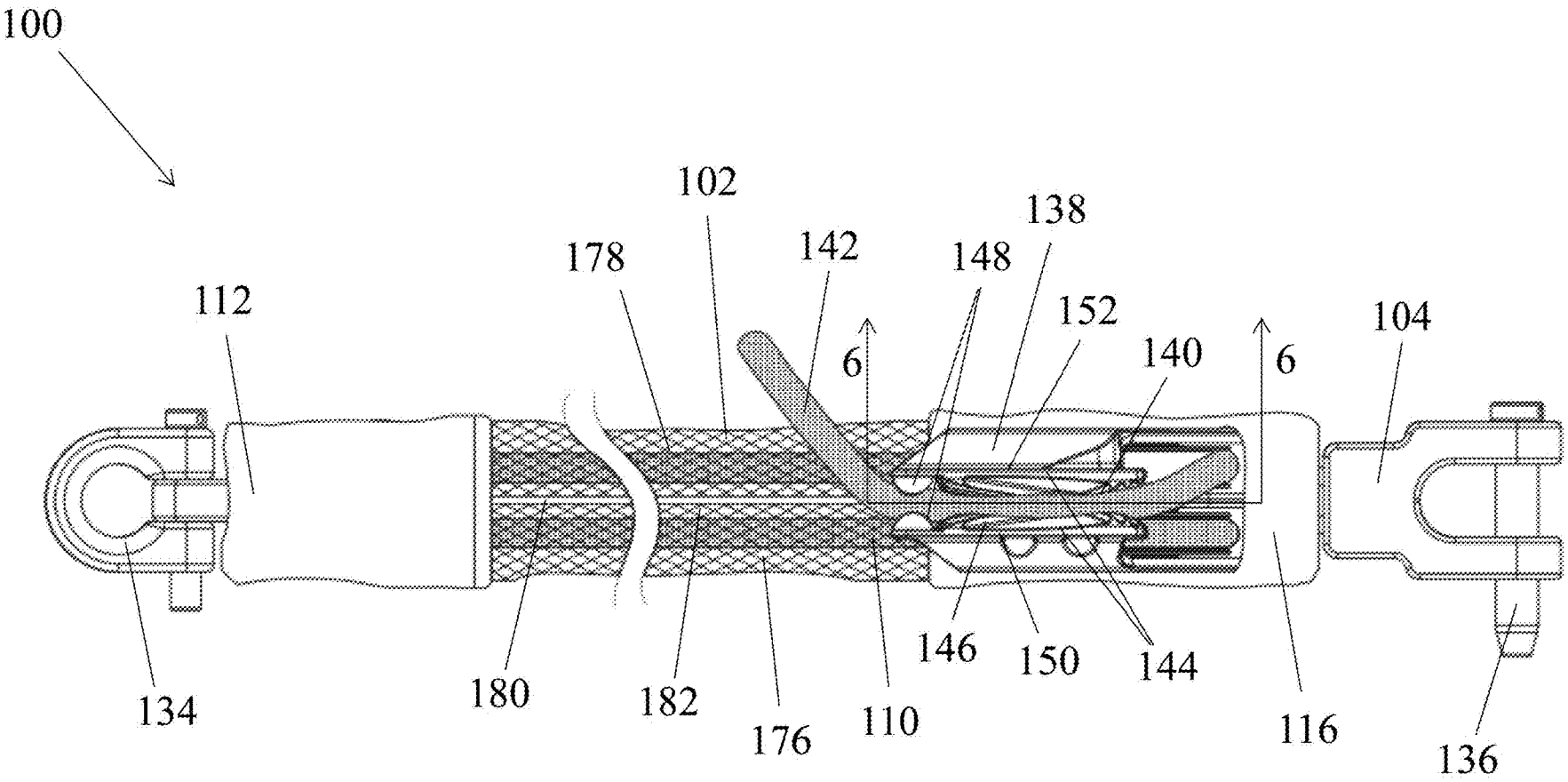
FIG. 5A is a top view of the pulley system of FIG. 2 with a mesh bag surrounding the block and tackle assembly and the second portion of the rope inside of the jammer.
Figure 5B:
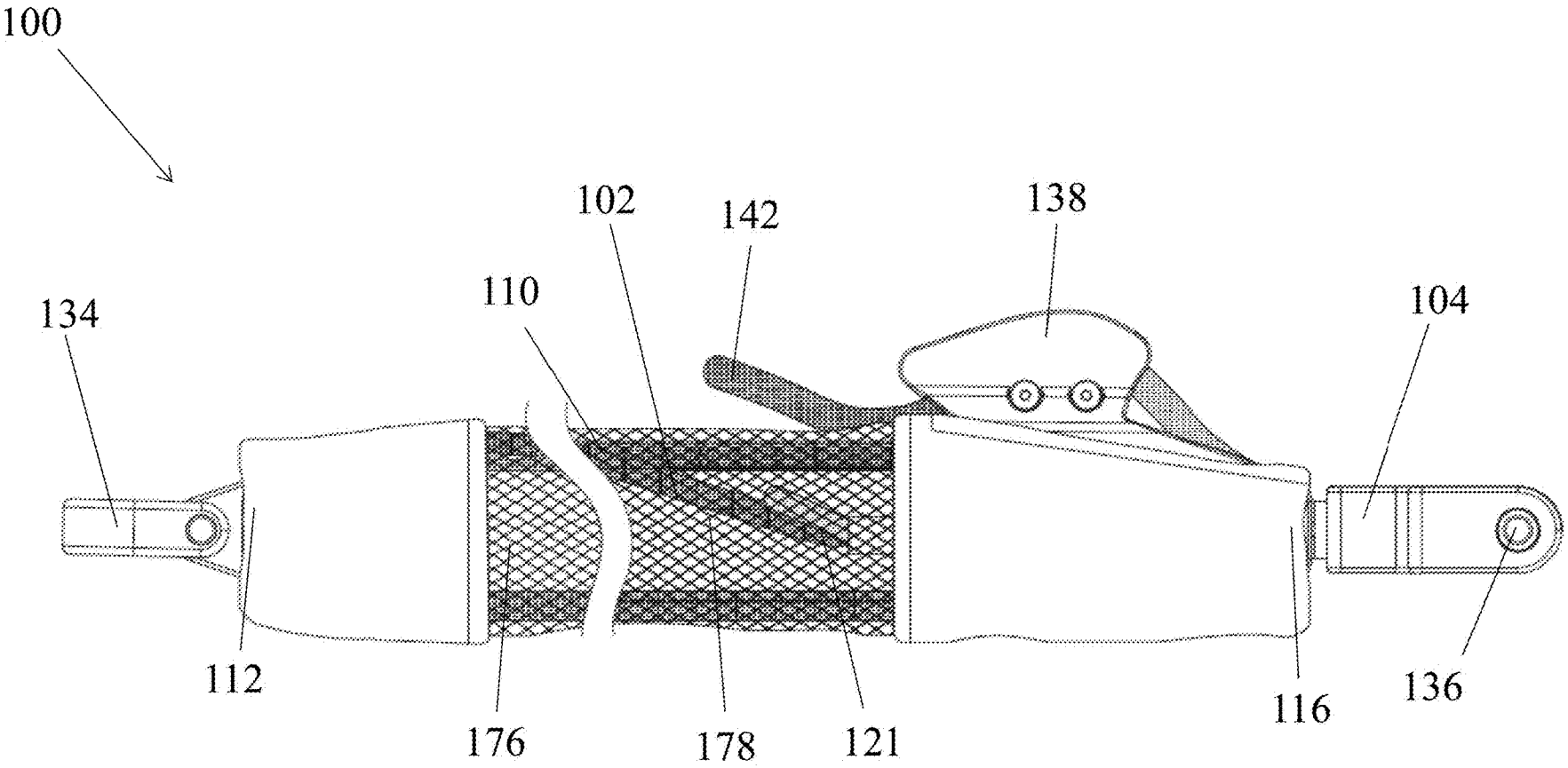
FIG. 5B is a side view of the pulley system of FIG. 2 with a mesh bag surrounding the block and tackle assembly and the second portion of the rope inside of the jammer.

The block and tackle assembly 102 shown in FIGS. 1-2 has a plurality of pulleys 108 and a first rope 110. The plurality of pulleys 108 is divided into a first group of pulleys 111 on a first end 112 of the block and tackle assembly 102 and a second group of pulleys 114 on a second end 116 of the block and tackle assembly 102. Each pulley in the first group of pulleys 111 is rotatably coupled to a first bracket 118, while each pulley in the second group of pulleys 114 is rotatably coupled to a second bracket 120. The pulleys belonging to a single group of pulleys, such as the first group 111 or the second group 114, may be axially aligned with each other. The second end 116 and the second bracket 120 are distal to the first end 112 and the first bracket 118. A first portion 121 of the first rope 110 may be fixedly coupled to the second bracket 120. For example, a crimp may be used to fixedly couple the first portion 121 of the first rope 110 to the second bracket 120. The plurality of pulleys 108 are configured to receive the first rope 110 strung through each pulley of the plurality of pulleys 108. The first rope 110 may be strung through each pulley, alternating between the first group of pulleys 111 and the second group of pulleys 114 and ending with a last pulley 122.

For example, in the embodiments shown in FIGS. 1-5B, the first group of pulleys 111 includes a first pulley 124 and a third pulley 126, while the second group of pulleys 114 includes a second pulley 128 and a fourth pulley 130. The first pulley 124 and the third pulley 126 are axially aligned with each other, and the second pulley 128 and the fourth pulley 130 are axially aligned with each other. The first rope 110 is strung sequentially through the first pulley 124, the second pulley 128, the third pulley 126, and the fourth pulley 130. In the embodiment shown, the last pulley 122 is the fourth pulley 130.

The first bracket 118 has a plurality of slots 132 configured to receive and hold a pulley. In addition, the first bracket 118 may have a first system coupling 134 configured to couple to the boat 10. The first system coupling 134 allows the block and tackle assembly 102 to either attach directly to the boat 10 through a rope, or to another component that then attaches to the boat 10, such as the rope clip 106 (see FIG. 1). Similar to the first bracket 118, the second bracket 120 has a plurality of slots 132 configured to receive and hold a pulley, and may have a second system coupling 136 configured to couple to the anchor 20. Other components may be placed in between the second bracket 120 and the second system coupling 136, such as the swivel 104 (see FIG. 1).

As shown in FIGS. 1-6, the second bracket 120 may also have a jammer 138. The jammer 138 has a channel 140 configured to receive and hold a second portion 142 of the first rope 110 between two walls 144 of the channel 140. The jammer 138 may have a plurality of teeth 146 and a plurality of dimples 148 each extending from the walls 144 into the channel 140. As specifically shown in FIG. 6, the plurality of teeth 146 and the plurality of dimples 148 are configured to secure the second portion 142 of the first rope 110 within the channel 140 and provide additional grip. The plurality of teeth 146 acts to grip the first rope 110 while still allowing the first rope 110 to pass through the channel 140. The plurality of dimples 148 are configured to stop the first rope 110 from slipping out of the channel. For example, a dimple 148 on a first wall 150 of the two walls 144 of the channel 140 may be aligned with a dimple 148 on a second wall 152 of the two walls 144, and a width of a gap 154 between the dimple 148 on the first wall 150 and the dimple 148 on the second wall 152 may be smaller than a width of the first rope 110. Thus, the first rope 110 is limited in its ability to pass between the dimple 148 on the first wall 150 and the dimple 148 on the second wall 152 (see FIGS. 3A and 5A). The jammer 138 may also have a jammer exit 155 at the end of the channel 140. The first rope 110 exits the channel 140 and the jammer 138 through the jammer exit 155. The plurality of dimples 148 may be at the jammer exit 155.

Figure 6:
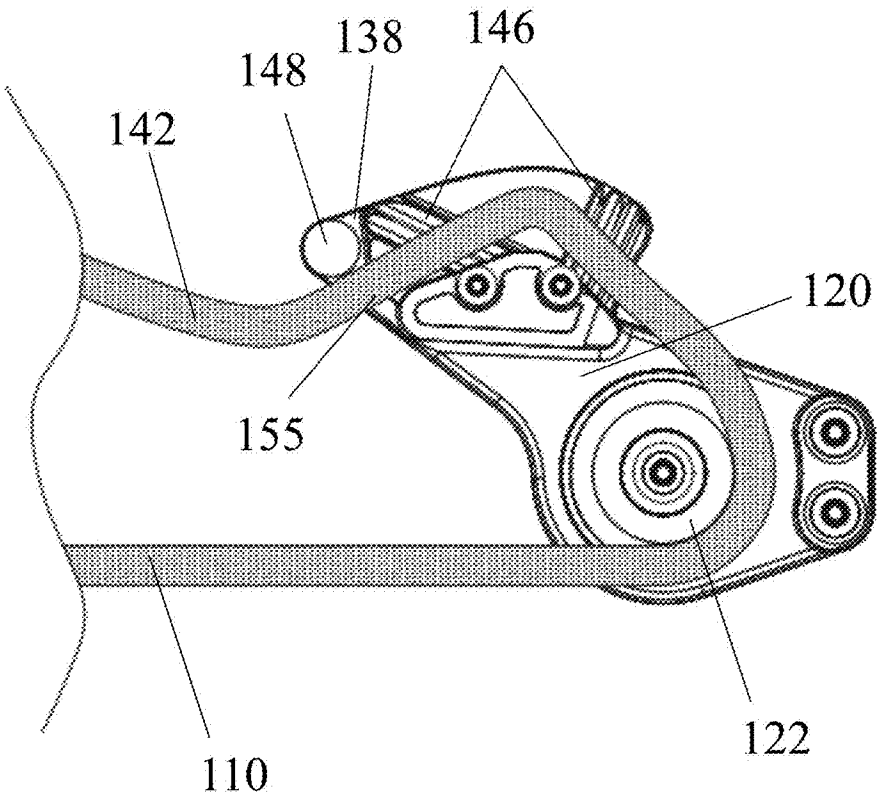
FIG. 6 is a cross section view of the second bracket from FIG. 5A taken along line 6-6 with a rope extending around the last pulley and through the jammer.

Continuing with FIG. 6, the pulley system 100 is configured to receive the first rope 110 threaded around the last pulley 122, through the jammer 138, and out the jammer exit 155. The placement of the jammer 138 on the second bracket 120 is selected so that the first rope 110 is less able to slip out of the channel 140. For example, the pulley 122, the channel 140 of the jammer 138, and the jammer exit 155 may be configured to create a tortuous path of the rope 110 through the second bracket 120. The tortuous path may begin where the rope 110 loses contact with the pulley 122 and may end at the jammer exit 155. The tortuous path helps to grip the rope 110 and prevent the rope 110 from slipping back through the jammer 138 once the pulley system 100 has been tightened. The rope 110 changes direction along the tortuous path as the rope 110 winds around the pulley 122 and through the channel 140. This change in direction may be as small as 5 or 10 degrees, more than 20 degrees, more than 45 degrees, or as large as 180 degrees or more. As an example, FIG. 6 illustrates that the rope 110 changed direction by just under 90 degrees counter-clockwise along the tortuous path. As another example, the rope 110 may change direction by 45 degrees clockwise as the rope 100 enters the channel 140, and then change direction by 45 degrees counter-clockwise within the channel 140 before exiting through the jammer exit 155. This would be considered a total change in direction of 90 degrees for the purposes of this application, despite the fact that the net change in direction is 0 degrees.

To further aid in gripping the rope 110, the channel 140 may be misaligned with the last pulley 122 that the first rope 110 passes through. This misalignment creates an angle between the first rope 110 and the channel 140, increasing the ability of the channel 140 to grip the first rope 110 (see FIG. 5A). The channel 140 may also be misaligned with other pulleys of the second group of pulleys 114. For example, the channel 140 may be misaligned with the second pulley 128 and the fourth pulley 130. Misaligning the channel 140 with the last pulley 122 may mean that the jammer 138 is placed with the channel 140 aligned between two pulleys, aligned with a pulley that is not the last pulley 122, or in a position that is not aligned with any component of the second bracket 120. For example, the jammer 138 shown in FIG. 1 has the channel aligned between the second pulley 128 and the fourth pulley 130. In other embodiments, the jammer 138 may be positioned on a side 156 of the second bracket 120 (not shown). In such an embodiment, the channel 140 may run horizontally, similar to the channel 140 shown in FIG. 1, or may run vertically. The jammer 138 may also be placed on the first bracket 118 in many of these same configurations and with the same effect. In embodiments where the jammer 138 is coupled with the second bracket 120, a first distance 158 between the jammer 138 and the first bracket 118 may be smaller than a second distance 160 between the last pulley 122 and the first bracket 118 (see FIG. 3B).

The swivel 104 may be coupled to the second bracket 120 and to a second rope 162. Alternatively, the swivel 104 may be coupled between the block and tackle assembly 102 and the first system coupling 134, or between the block and tackle assembly 102 and the second system coupling 136. The second rope 162 may be used to couple the pulley system 100 to the anchor 20. The swivel 104 is configured to rotate at least 360 degrees in both a clockwise direction and a counterclockwise direction. The swivel 104 thus facilitates use of the pulley system 100 because the user does not need to untwist all of the ropes before connecting each of the components. If each of the components are connected and the pulley system 100 is tied to a boat 10 and an anchor 20 while the ropes are twisted, the swivel 104 allows the ropes to untwist by rotating until the ropes are untwisted. The rotation of the swivel 104 may occur about an axis 164 extending through the first bracket 118 and the second bracket 120 (see FIG. 3B).

Figure 7A:
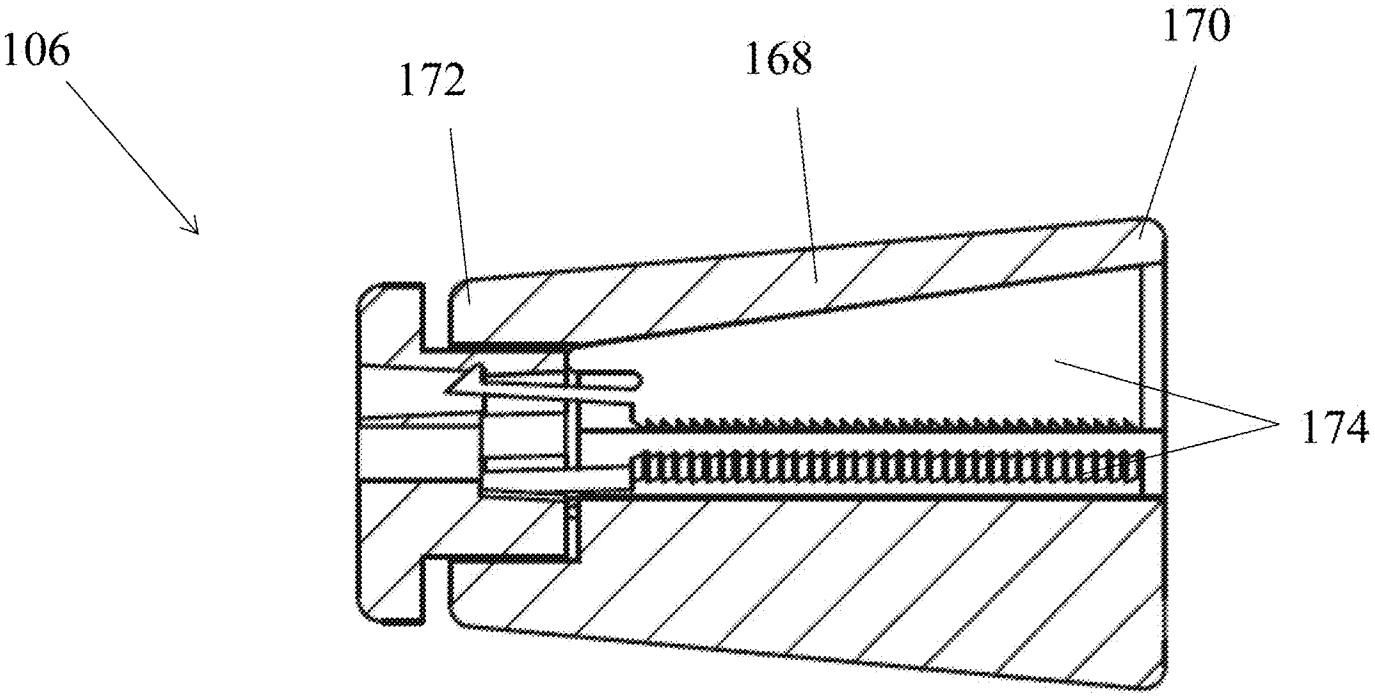
FIG. 7A is a cross section view of the rope clip shown in FIG. 1 taken along line 7-7 without the rope extending the center.
Figure 7B:
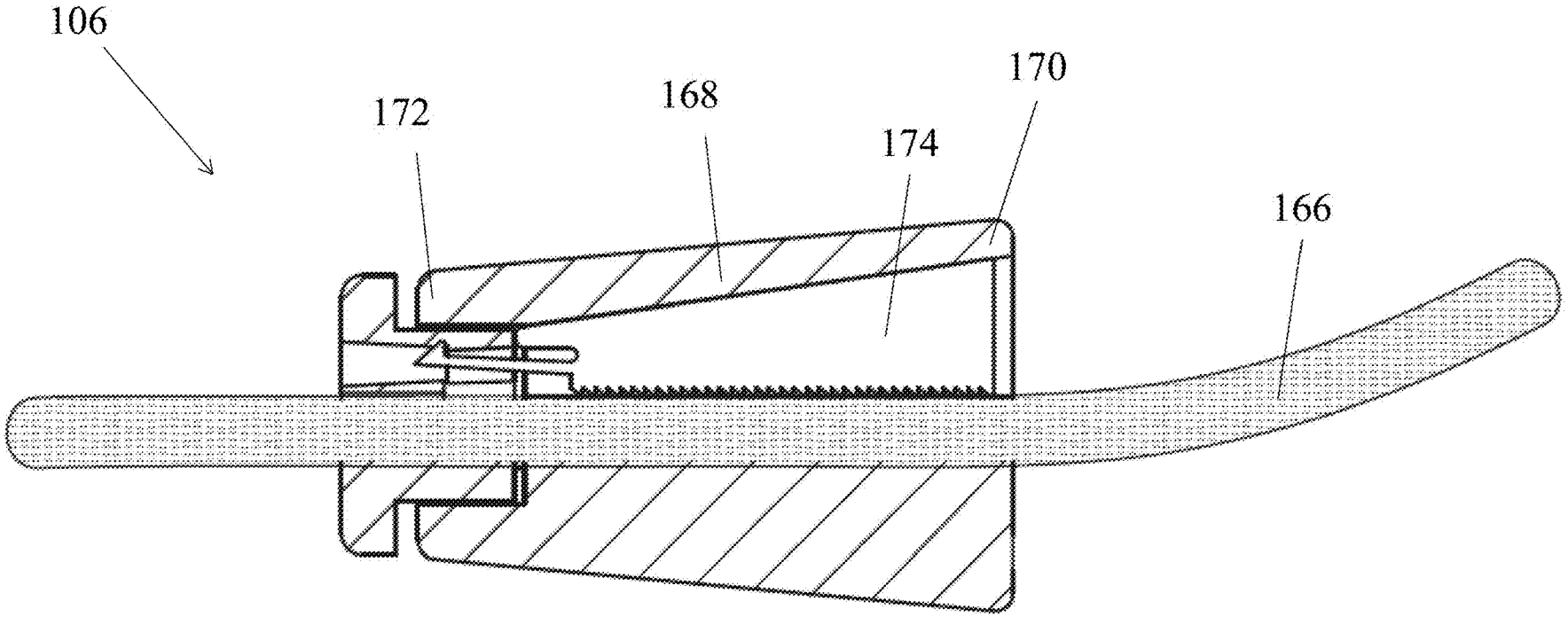
FIG. 7B is a cross section view of the rope clip shown in FIG. 1 taken along line 7-7 with the rope extending through the center.

The rope clip 106, shown in FIG. 1, may be hingedly coupled to the first bracket 118 and coupled to a third rope 166. Alternatively, the rope clip 106 may be coupled between the boat 10 and the first system coupling 134 or between the anchor 20 and the second system coupling 136. The rope clip may comprise a housing 168 having a large end 170 adjacent the first bracket 118 and a small end 172 distal to the first bracket 118. If coupled between the anchor and the second system coupling 136, the large end 170 is adjacent second bracket 120 while the small end 172 is distal to the second bracket 120. As shown in FIGS. 7A-7B, the housing 168 also has a plurality of sets of teeth 174 between the large end 170 and the small end 172. The large end 170 has a larger cross-sectional area than the small end 172. The housing 168 is configured to receive the third rope 166 through the large end 170 and the small end 172. The third rope 166 thus may extend through a gap between the plurality of sets of teeth 174 within the rope clip 106. The plurality of sets of teeth 174 are configured to move closer to each other when pulled toward the small end 172 and farther away from each other when pulled toward the large end 170. Therefore, when the third rope 166 extends through the rope clip 106 and is drawn away from the block and tackle assembly 102, the third rope 166 moves the plurality of sets of teeth 174 toward the small end 172, causing the gap between the plurality of sets of teeth 174 to tighten around the third rope 166. On the other hand, when the third rope 166 extends through the rope clip 106 and is drawn toward the block and tackle assembly 102, the third rope 166 moves the plurality of sets of teeth 174 toward the large end 170, causing the gap between the plurality of sets of teeth 174 to widen and release the third rope 166. Thus, the third rope 166 can be drawn through the rope clip 166 toward the block and tackle assembly 102 easily, shortening the distance between the anchor tie-off assembly 100 and the boat 10 or the anchor 20. Once tightened, the plurality of sets of teeth 174 grip the third rope 166 and limit the ability of the third rope 166 be drawn back through the rope clip 106 away from the block and tackle assembly 102. Another small movable object, such as a ball or wedge, may be used in place of each of the sets of teeth 174 in other embodiments.

As illustrated by FIGS. 4A-5B, the pulley system 100 may also have a mesh bag 176. The mesh bag 176 may be made of a mesh material with a plurality of small apertures 178 extending through the mesh material. The plurality of small apertures 178 are configured to allow the user to see a relative alignment of the first rope 110 through the mesh material. The mesh bag 176 may surround a majority of the block and tackle assembly 102 and may be positionally attached to each of the first bracket 118 and the second bracket 120. The mesh bag 176 separates the length of the first rope 110 that is strung through the plurality of pulleys 108 from the remainder of the first rope 110, and limits the entanglement of these two portions of the first rope 110. The mesh bag may also have a marker line 180 on a side 182 of the mesh bag 176. The marker line 180 is configured to maintain its position on the side 182 of the mesh bag 176 and indicates whether the plurality of pulleys 108 and the first rope 110 of the block and tackle assembly 102 within the mesh bag 176 are properly aligned for untangled operation of the block and tackle assembly 102. For example, when the plurality of pulleys 108 and the first rope 110 are twisted or entangled, the marker line 180 twists around the block and tackle assembly 102. Once the plurality of pulleys 108 and the first rope 110 have been straightened out, the marker line 180 continues straight down the side 182 of the mesh bag 176, thus indicating that the block and tackle assembly 102 is straightened.

Figure 8:
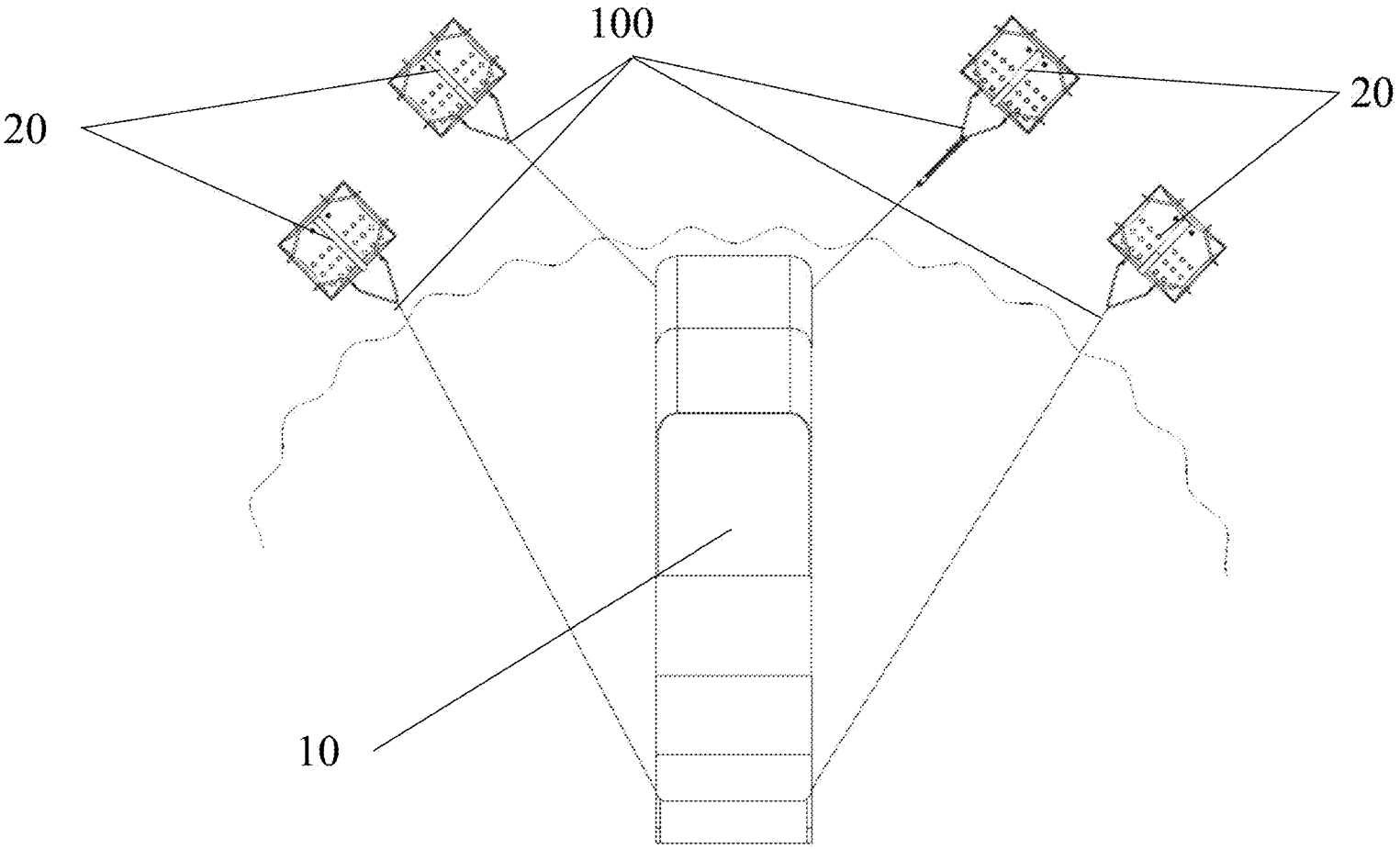
FIG. 8 is a top view of a boat anchored to the shore using a plurality of pulley systems.

When a user of the pulley system 100 desires to tie the boat 10 to the anchor 20, the user couples the first system coupling 134 to the boat 10 using a rope, preferably to a cleat affixed to the boat 10, and couples the second system coupling 136 to the anchor 20 using a rope. The swivel 104 may then be used to untwist the pulley system 100 if needed. The rope clip 106 may be used to rapidly tighten the pulley system 100 as far as the user can pull the rope through the rope clip 106 manually. At this point, the block and tackle assembly 102 becomes useful to further tighten the ropes and secure the boat 10 in place. As a result of the configuration of the plurality of pulleys 108 and the first rope 110, mechanical advantage is provided to the user, allowing the user to tighten the ropes further while exerting less force than would otherwise be required. The second portion 142 of the first rope 110 may then be secured by the jammer 138, as described in detail above. As a result of the misaligned channel 140, the plurality of teeth 146, and the plurality of dimples 148 of the jammer 138, the first rope 110 remains tightened, with minimal slippage occurring. Thus, the boat 10 can be securely coupled to the anchor 20. Additional pulley systems 100 may be used with additional anchors 20 to further ensure that the boat 10 stays in place, as shown in FIG. 8.

It will be understood that implementations of the pulley system are not limited to the specific assemblies, devices and components disclosed in this document, as virtually any assemblies, devices and components consistent with the intended operation of the pulley system may be used. Accordingly, for example, although particular pulley systems, and other assemblies, devices and components are disclosed, such may include any shape, size, style, type, model, version, class, measurement, concentration, material, weight, quantity, and/or the like consistent with the intended operation of pulley systems. Implementations are not limited to uses of any specific assemblies, devices and components; provided that the assemblies, devices and components selected are consistent with the intended operation of the pulley system.

Accordingly, the components defining any pulley system implementations may be formed of any of many different types of materials or combinations thereof that can readily be formed into shaped objects provided that the components selected are consistent with the intended operation of an pulley system implementation. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various pulley systems may be manufactured using conventional procedures as added to and improved upon through the procedures described here. Some components defining a pulley system may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that pulley systems are not limited to the specific order of steps as disclosed in this document. Any steps or sequence of steps of the assembly of a pulley system indicated herein are given as examples of possible steps or sequence of steps and not as limitations, since various assembly processes and sequences of steps may be used to assemble pulley systems.

The implementations of the pulley system described are by way of example or explanation and not by way of limitation. Rather, any description relating to the foregoing is for the exemplary purposes of this disclosure, and implementations may also be used with similar results for a variety of other applications employing a pulley system.

What is claimed is:

1. A pulley system for tying a boat to an anchor, comprising:

a block and tackle assembly having a plurality of pulleys and a first rope, wherein a first pulley and a third pulley of the plurality of pulleys are axially aligned with each other and rotatably coupled to a first bracket, a second pulley and a fourth pulley of the plurality of pulleys are axially aligned with each other and rotatably coupled to a second bracket distal to the first bracket, the first rope is strung sequentially through the first pulley, the second pulley, the third pulley, and the fourth pulley, and a first portion of the first rope is fixedly coupled to the second bracket;

a mesh bag surrounding a majority of the block and tackle assembly and positionally attached to each of the first bracket and the second bracket, the mesh bag having a marker line on a side of the mesh bag, the marker line configured to maintain its position on the side of the mesh bag and indicate whether the plurality of pulleys and the first rope of the block and tackle assembly within the mesh bag are properly aligned for untangled operation of the block and tackle assembly;

a jammer coupled to the second bracket and having a channel misaligned with the second pulley and the fourth pulley, wherein the channel has two walls each with a plurality of teeth and a dimple extending into the channel between the two walls, wherein the jammer is configured to receive a second portion of the first rope within the channel and secure the second portion of the first rope with the plurality of teeth and the dimples;

a swivel coupled to the second bracket of the block and tackle assembly and to a second rope, the swivel configured to rotate 360 degrees in both a clockwise direction and a counterclockwise direction; and a rope clip hingedly coupled to the first bracket of the block and tackle assembly and coupled to a third rope, wherein the rope clip comprises a housing having a large end adjacent to the first bracket, a small end distal to the first bracket, and a plurality of sets of teeth between the large end and the small end, the large end having a larger cross-sectional area than the small end, wherein the third rope extends through a gap between the plurality of sets of teeth within the rope clip and the plurality of sets of teeth within the housing are configured to move closer to each other near the small end and farther away from each other near the large end;

wherein when the third rope extends through the rope clip and is drawn away from the block and tackle assembly, the third rope moves the plurality of sets of teeth toward the small end and the gap between the plurality of sets of teeth tightens around the third rope; and wherein, when the third rope extends through the rope clip and is drawn toward the block and tackle assembly, the third rope moves the plurality of sets of teeth toward the large end and the gap between the plurality of sets of teeth widens, thereby releasing the third rope.

2. The pulley system of claim 1, wherein the dimple on a first wall of the two walls is aligned with the dimple on a second wall of the two walls and a width of a gap between the dimple on the first wall and the dimple on the second wall is smaller than a width of the first rope.

3. The pulley system of claim 1, wherein the rotation of the swivel occurs about an axis extending through the first bracket and the second bracket.

4. The pulley system of claim 1, wherein the mesh bag is made of a mesh material with a plurality of small apertures extending through the mesh material, wherein the small apertures are sized to allow a user to see a relative alignment of the first rope through the mesh material.

5. A pulley system for tying a boat to an anchor, comprising:

a block and tackle assembly having a plurality of pulleys, wherein each pulley of a first group of pulleys of the plurality of pulleys is coupled to a first bracket on a first end of the block and tackle assembly, each pulley of a second group of pulleys of the plurality of pulleys is coupled to a second bracket on a second end of the block and tackle assembly distal to the first bracket, and the plurality of pulleys is configured to receive a first rope, fixedly coupled to the second bracket, through each pulley of the plurality of pulleys, ending with a last pulley on the second bracket;

the second bracket having a jammer with a channel and a jammer exit at an end of the channel, wherein the pulley system is configured to receive a second portion of the first rope threaded around the pulley, through the jammer, and out the jammer exit;

wherein the last pulley, the channel of the jammer, and the jammer exit are configured to create a tortuous path for the rope through the second bracket, the tortuous path begins where the rope loses contact with the last pulley and ends at the jammer exit, and the rope changes direction by more than 20 degrees along the tortuous path; and wherein the first end has a first system coupling configured to couple to a boat and the second end has a second system coupling configured to couple to an anchor.

6. The pulley system of claim 5, at least one of the first end or the second end further comprising a rope clip coupled between the boat and the first system coupling or between the anchor and the second system coupling, wherein the rope clip is configured to secure a third rope when the third rope extends through the rope clip and is drawn away from the block and tackle assembly, and release the third rope when the third rope extends through the rope clip and is drawn toward the block and tackle assembly.

7. The pulley system of claim 6, wherein the rope clip comprises a housing having a large end adjacent to the first bracket, a small end distal to the first bracket, and a plurality of sets of teeth between the large end and the small end, the large end having a larger cross-sectional area than the small end, wherein the third rope extends through a gap between the plurality of sets of teeth within the rope clip and the plurality of sets of teeth within the housing are configured to move closer to each other near the small end and farther away from each other near the large end, wherein, when the third rope extends through the rope clip and is drawn away from the block and tackle assembly, the third rope moves the plurality of sets of teeth toward the small end and the gap between the plurality of sets of teeth tightens around the third rope, and wherein, when the third rope extends through the rope clip and is drawn toward the block and tackle assembly, the third rope moves the plurality of sets of teeth toward the large end and the gap between the plurality of sets of teeth widens, thereby releasing the third rope.

8. The pulley system of claim 5, further comprising a mesh bag surrounding a majority of the block and tackle assembly and positionally attached to each of the first bracket and the second bracket, the mesh bag having a marker line on a side of the mesh bag, the marker line configured to maintain its position on the side of the mesh bag and indicate whether the plurality of pulleys and the first rope of the block and tackle assembly within the mesh bag are properly aligned for untangled operation of the block and tackle assembly.

9. The pulley system of claim 5, wherein the rotation of the swivel occurs about an axis extending through the first bracket and the second bracket.

10. The pulley system of claim 5, the jammer further having a plurality of teeth extending into the channel, wherein the jammer is configured to secure the second portion of the first rope with the plurality of teeth.

11. The pulley system of claim 5, the jammer exit having at least two dimples, wherein the at least two dimples are located on opposite walls of the channel, each of the at least two dimples are aligned with another of the at least two dimples, and a gap between the at least two dimples is smaller than a width of the first rope.

12. The pulley system of claim 5, wherein the channel is misaligned with the last pulley of the plurality of pulleys.

13. The pulley system of claim 5, at least one of the first end or the second end further having a swivel coupled directly to the first system coupling or the second system coupling and configured to rotate 360 degrees.

14. A pulley system for tying a boat to an anchor, comprising:

a bracket having at least one pulley and a jammer positioned to receive a rope from the at least one pulley, the jammer having a channel and a jammer exit at the end of the channel, wherein the pulley system is configured to receive a rope threaded around the pulley, through the jammer, and out the jammer exit;

wherein the pulley, the channel of the jammer, and the jammer exit are configured to create a tortuous path for the rope through the bracket comprising a direction change of at least 20 degrees along the tortuous path, wherein the tortuous path begins where the rope loses contact with the pulley and ends at the jammer exit; and wherein the channel is misaligned with the at least one pulley.

15. The pulley system of claim 14, the jammer further having a plurality of teeth extending into the channel, wherein the jammer is configured to secure the rope within the channel with the plurality of teeth.

16. The pulley system of claim 14, the jammer exit having at least two dimples, wherein the at least two dimples are located on opposite walls of the channel, each of the at least two dimples are aligned with another of the at least two dimples, and a gap between the at least two dimples is smaller than a width of the first rope.

17. The pulley system of claim 14, wherein the bracket is a second bracket, the pulley system further comprising a block and tackle assembly configured to receive the rope, wherein the block and tackle assembly has a plurality of pulleys including the at least one pulley, wherein each pulley of a first group of pulleys of the plurality of pulleys is coupled to a first bracket on a first end of the block and tackle assembly, each pulley of a second group of pulleys of the plurality of pulleys is coupled to the second bracket on a second end of the block and tackle assembly distal to the first bracket, and the plurality of pulleys is configured to receive the rope, fixedly coupled to the second bracket, through each pulley of the plurality of pulleys, ending with the at least one pulley.

18. The pulley system of claim 17, further comprising a mesh bag surrounding a majority of the block and tackle assembly and positionally attached to each of the first bracket and the second bracket, the mesh bag having a marker line on a side of the mesh bag, the marker line configured to maintain its position on the side of the mesh bag and indicate whether the plurality of pulleys and the first rope of the block and tackle assembly within the mesh bag are properly aligned for untangled operation of the block and tackle assembly.

19. The pulley system of claim 17, wherein the rope changes direction by more than 20 degrees along the tortuous path.

* * * * *